United States Patent [19]

Campbell

[11] Patent Number: 4,923,130

[45] Date of Patent: May 8, 1990

[54] DEVICE FOR CRUSHING AND CUTTING PLANT MATERIAL

[76] Inventor: James S. Campbell, 74 Sleepy Hollow La., Orinda, Calif. 94563

[21] Appl. No.: 339,395

[22] Filed: Apr. 17, 1989

[51] Int. Cl.[5] ..... B02C 18/06

[52] U.S. Cl. ..... 241/236; 241/285 B

[58] Field of Search ..... 241/166, 190, 235, 236, 241/242, 285 A, 285 B

[56] References Cited

U.S. PATENT DOCUMENTS 1,010,062 11/1911 Lyon ..... 241/236 X
3,931,935 1/1976 Holman ..... 241/236 X
4,643,108 2/1987 Singelyn et al. ..... 241/235 X

FOREIGN PATENT DOCUMENTS 2632330 1/1978 Fed. Rep. of Germany ... 241/285 B

*Primary Examiner*—Timothy V. Eley
*Attorney, Agent, or Firm*—Glen R. Grunewald

[57] ABSTRACT

A device for crushing plant material and including contra-rotating rotors comprising a core member with blades tangentially disposed thereon and projecting therefrom, said blades having flat sides and flat distal end surfaces disposed at substantially 90 degree angles to said sides and interconnected thereto along sharp edges.

12 Claims, 3 Drawing Sheets

DEVICE FOR CRUSHING AND CUTTING PLANT MATERIAL

TECHNICAL FIELD

This invention relates to apparatus which is adapted to cut, tear, and compress plant materials such as branches, cuttings or the like. After passing through the apparatus the plant material is in a condition for disposal, including use of such material as compost.

BACKGROUND ART

My U.S. Pat. No. 3,735,933, issued May 29, 1973, discloses an apparatus for the disposal of cuttings or the like which is adapted to cut, tear and to press such cuttings to prepare the same for composting. The apparatus of this prior patent utilizes a pair of adjacent, generally parallel contra-rotating rotors. Each of the rotors has circumferentially-spaced blades at a rake angle in the direction of rotation, with the blades of one rotor overlapping those of the other rotor during rotation. In U.S. Pat. No. 3,735,933, each rotor includes at least 12 blades disposed at a rake angle of about 20 degrees.

DISCLOSURE OF THE INVENTION

The present invention also relates to apparatus for the disposal of cuttings or the like utilizing a pair of adjacent, generally parallel, contra-rotating rotors to cut, tear, and compress plant material. However, apparatus constructed in accordance with the teachings of the present invention incorporates several novel features which contribute to the efficiency and effectiveness of the apparatus as compared with that disclosed in U.S. Pat. No. 3,735,933.

In particular, the present invention includes a housing defining an interior and an inlet and outlet communicating with the interior. A pair or rotors is rotatably mounted within the interior and define a passageway therebetween between the inlet and the outlet. Each of the rotors includes a cylindrically-shaped core member and a plurality of generally uniformly-spaced blades projecting outwardly from the core member, each said blade having a positive rake angle, spaced sides, and a distal end. The distal end has a flat surface disposed at substantially 90 degree angles to the sides and interconnected to the sides along sharp edges.

The rotor blades of the present invention operate considerably more efficiently than the blades of the apparatus disclosed in U.S. Pat. No. 3,735,933. The rotor blades of the present invention are particularly superior when performing their initial function of qrasping and grabbing branches and other objects being fed to the rotor and allow branches of larger diameter to be passed therebetween. Further, the present blades cooperate to more effectively crush the material passing through the rotor, a result which is particularly desirable when the material is to be used as compost or mulch.

The rotors of the apparatus disclosed herein are also cheaper in construction and lighter in weight than the rotors shown in U.S. Pat. No. 3,735,933. And, since the ends of the blades of this invention are essentially squared-off, they are easier to maintain in sharpened condition.

In the illustrated preferred embodiment of the invention, the rake angle of the blades is substantially 36 degrees and six blades project outwardly from the core member. Each core member comprises a shaft and a tubular spacer secured to the shaft and the blades, each said tubular spacer being shorter than the shaft to which the tubular spacer is secured whereby the ends of the tubular spacers ar adapted to define thrust-bearing surfaces. These structural elements may readily be secured together, as by welding.

Another novel feature of apparatus constructed in accordance with the teachings of the present invention is a deflector plate in operative association with at least one of the rotors. The deflector plate has a terminal portion in close proximity to the distal ends of blades on its associated rotor whereby the deflector plate terminal portion is adapted to be engaged by material adhering to the blade distal ends upon rotation of the rotor and to remove such material from the rotor. The deflector plate terminal portion includes a terminal edge and a deflector surface leading from the edge and adapted to direct material removed from the blade distal ends away from the rotor.

Yet another novel feature resides in the fact that the device housing is selectively rotatable above the shaft of one of the rotors. This enables the device to be readily adjusted to allow plant material to be selectively fed from different directions ranging from the vertical to the horizontal.

Other features, advantages, and objects of the present invention will become apparent with reference to the following detailed description and accompanying drawings.

DISCLOSURE OF THE INVENTION

Figure 1:
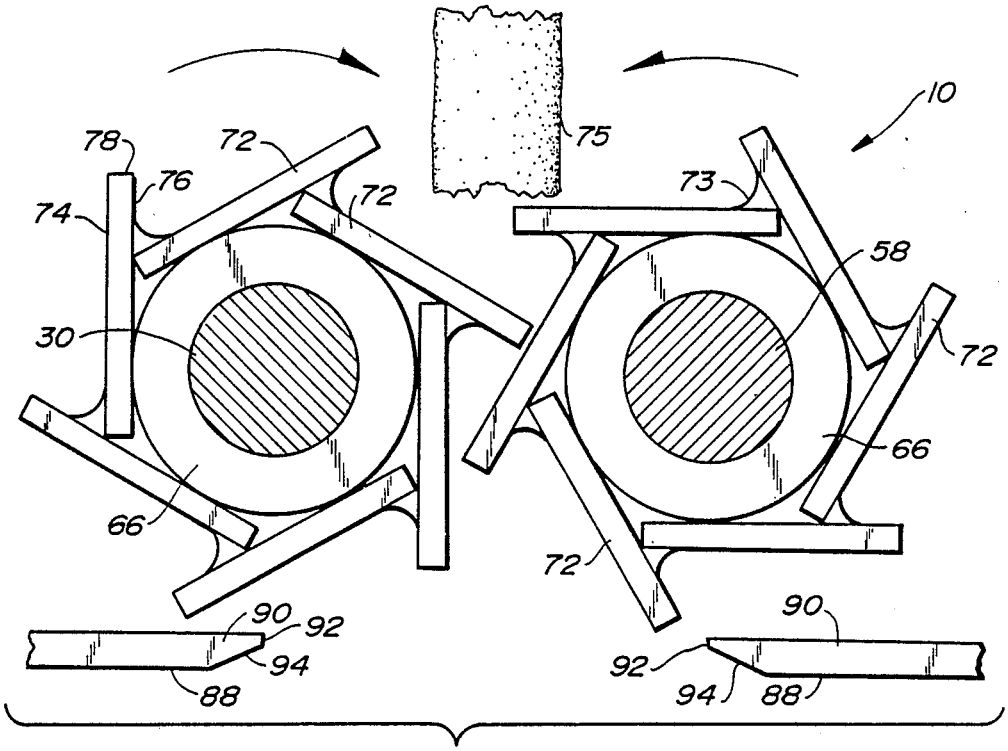
FIG. 1 is an enlarged, end view, partly in section, illustrating a pair of rotors utilized in a device constructed in accordance with the teachings of the present invention in operative association with deflector plates.

A device constructed in accordance with the teachings of the present invention is designated generally by reference numeral 10. The device 10 includes a base 12 upon which is mounted a prime mover 14 of any suitable type; for example, an electric motor or internal combustion engine. Through a suitable transmission means, such as gear-chain drive linkage 16, the prime mover 14 drives shaft 18 mounted in bearings 15, 17. A relatively large flywheel 20 is attached to shaft 18 and rotatable therewith. The flywheel, of course, stores kinetic energy and permits operation of the device even with a relatively small horsepower prime mover. If the prime mover stalls due to a too large branch being fed to the machine, the flywheel may be turned by hand to reverse machine direction and allow removal of the branch.

A gear 24 is mounted at one end of the shaft 18. The teeth of gear 24 mesh with those of a much larger diameter gear 26. For example, the small gear 24 may have in the order of 16 teeth while larger gear 26 may have in the order of 80 teeth.

Gear 26 is fixedly attached to a first rotor shaft 30, said first rotor shaft having one end thereof journalled as shown, in a bearing 34. The other end of the first rotor shaft 30 projects through bearings 36, 38 situated in side walls 40, 42, respectively, of a housing 44. Bearings 36, 38 may be of any desirable construction, although bronze journal-type bearings have been found to be particularly appropriate since they resist corrosion by vapors and gases given off by material crushed by the device.

A spur gear 52 is attached to first rotor shaft 30 at a location outside the confines of housing 44. Spur gear 52 meshes with another spur gear 54 attached to a second rotor shaft 58. Second rotor shaft 58 is rotatably journalled in bearings 60, 62, similar in construction to bearings 36, 38, positioned in side walls 40, 42 of housing 44.

Figure 2:
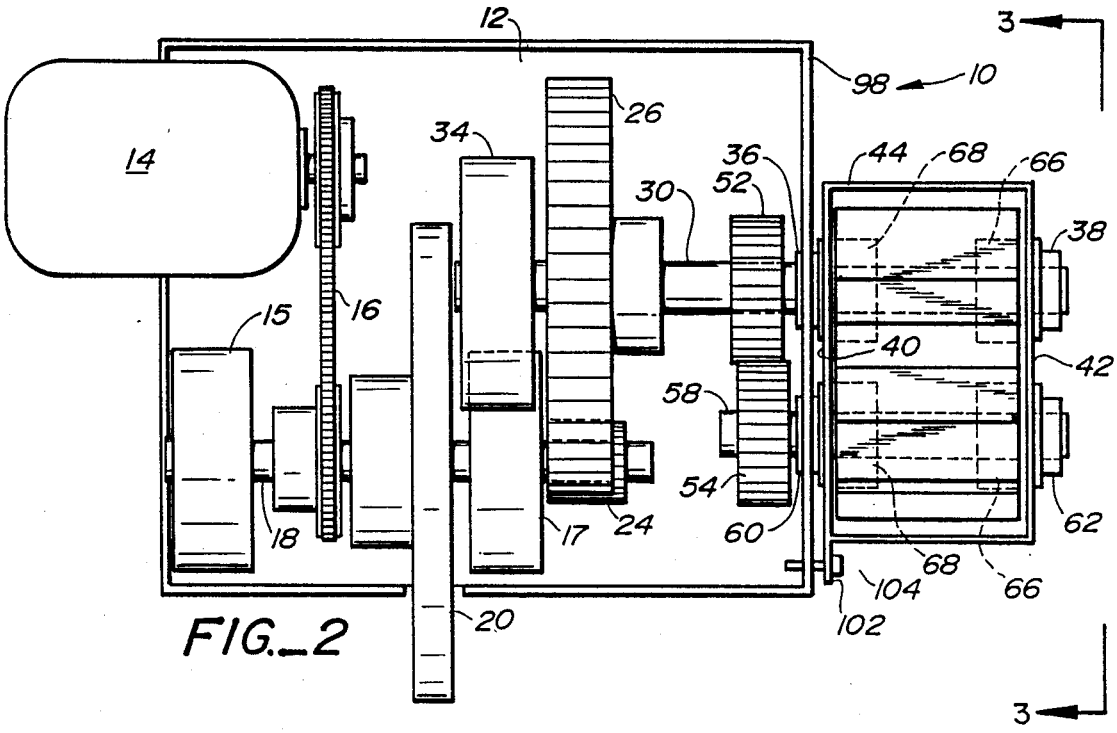
FIG. 2 is a plan view of a preferred form of device constructed in accordance with the teachings of the present invention.

As perhaps may best be seen with reference to FIGS. 1 and 2 a pair of tubular spacers 66, 68 are disposed about each of first and second rotor shafts 30, 58. FIG. 1 illustrates only tubular spacers 66. Together, each rotor shaft and its associated tubular spacers comprise a cylindrically-shaped core member. Preferably, the tubular spacers are secured to their respective rotor shafts in a permanent manner, such as by being welded thereto. Since the tubular spacers are shorter than the rotor shafts, they may be utilized so that the ends thereof operate as thrust-bearing surfaces against the adjacent bearings within which the rotor shafts are journalled.

Positively secured to the tubular spacers 66, 68 by being welded thereto are a plurality of generally uniformly spaced blades 72 projecting outwardly from the core member and disposed tangentially with respect to the spacers. The blades are also welded to each other as at welds 73. In the illustrated preferred embodiment, each of the blades 72 has a positive rake angle of about 36 degrees and there are six such blades projecting outwardly from the core member of each rotor. The term "rake angle" is well defined as being that angle which a blade makes with a radius from the center of the core member to the tip of the blade. U.S. Pat. No. 3,735,933 discloses a rotor assembly with blades having a rake angle in the order of 20 degrees; however, it has been found that a larger rake angle in the order of about 33 degrees or more assists in the functioning of the rotors to grasp the ends of branches (such as branch 75 in FIG. 1), especially larger diameter branches being processed through the device.

Another difference in this device as compared to that of U.S. Pat. No. 3,735,933, is that in the rotor assembly disclosed in that patent there are at least twelve blades on each rotor. It has been found that with a positive rake angle of about 33 degrees, rotors with six blades operate at least as efficiently as those with twelve blades or more, while the lesser number of blades greatly lowers manufacturing costs. Since the six blades of the disclosed present unit are separated by 60 degrees, welding of the rotor components is facilitated. Further, a six blade (or lesser blade number) construction lessens the likelihood of plant material jamming and sticking in the space between the blades. Since the blades, tubular spacers, and rotor shaft of each rotor are a welded unit, manufacturing becomes a much simpler task compared to the rotors of U.S. Pat. No. 3,735,933.

It will be noted that each blade 72, in addition to having a positive rake angle of about 33 degrees, has spaced sides 74, 76, and a distal end 78. Distal end 78 has a flat surface disposed at substantially 90 degree angles to the sides of the blade and is interconnected to the sides along sharp edges.

The configuration of these blades also helps to lower manufacturing costs and it has been found that the 90 degree edges which engage plant material passing through the rotors will remain sharp for longer periods of time than the blades disclosed in U.S. Pat. No. 3,735,933. The blades 72 can readily be made or cut from commercially available flat bars or plates of abrasion-resistant, heat treated steel.

When prime mover 14 rotates shaft 18 and gear 24, gear 26 will also be caused to rotate. Gear 26 drives both first rotor shaft 30 and second rotor shaft 58 through the cooperating spur gears 52, 54. Blades 72 of the two rotors counter rotate with the blades of one rotor entering the spaces between the blades of the other as they approach each other during rotation. This action can perhaps best be seen in FIGS. 1, 1A, 1B and 1C. The specific blade construction and smaller number of blades utilized in this invention enables the first and second rotor shafts to be brought closer together than would be the case when a larger number of blades or blades having a different rake angle were employed. This provides a mechanical advantage since one is operating with, in effect, a shorter moment arm. This enables a prime mover of smaller capacity to be utilized with consequent savings.

It will be appreciated that when plant matter is introduced into the interior of housing 44 through its inlet, the plant material will be engaged by the counter-rotating blades of the rotors and quickly conveyed through the passageway defined by the rotors to the housing outlet 84.

Figure 1A:
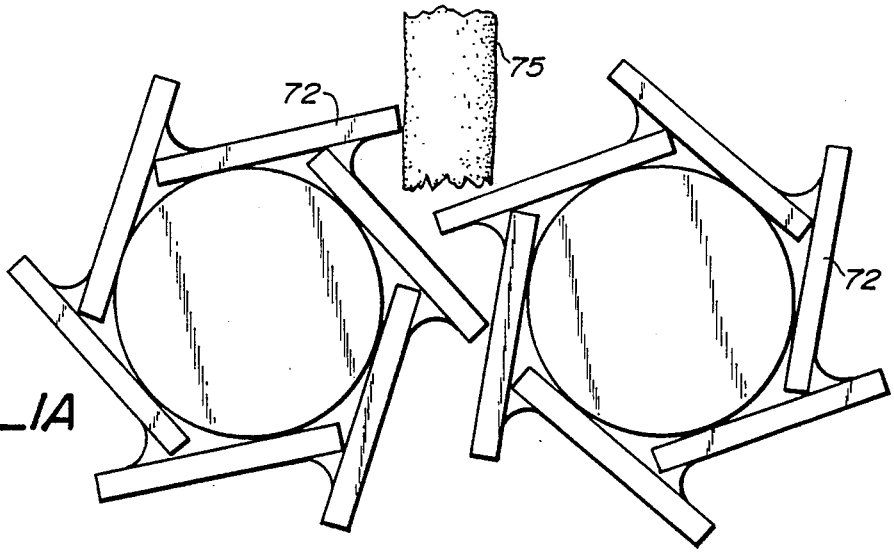
FIGS. 1A, 1B, and 1C are diagrammatic side views illustrating the rotors of FIG. 1 at various stages of their operation.
Figure 1B:
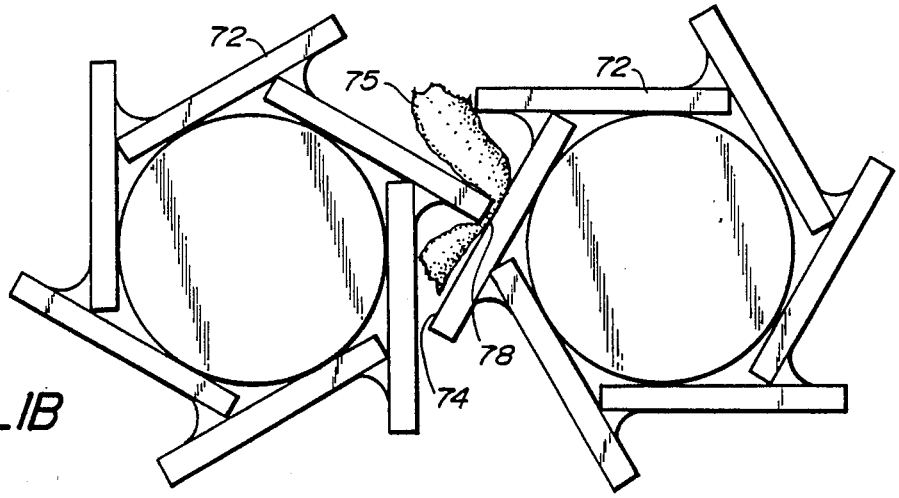
Figure 1C:
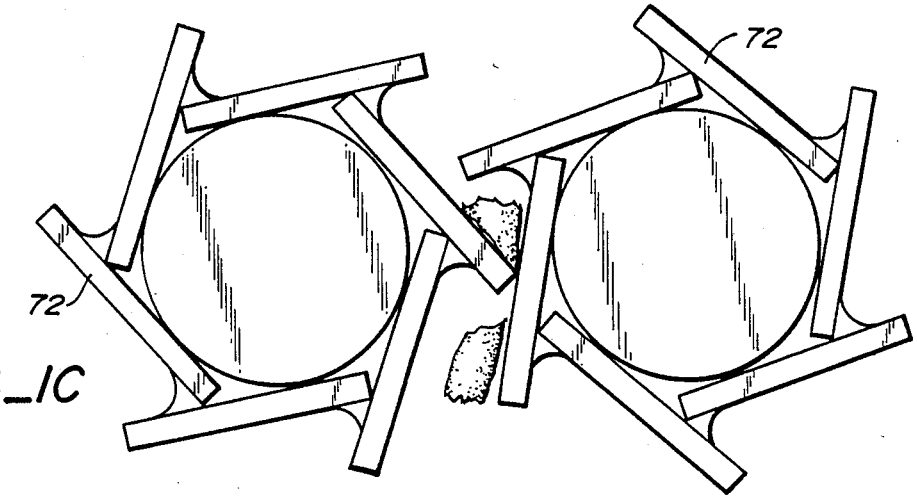

FIGS. 1A, 1B, and 1C are diagrammatic presentations showing a branch 75 (only a portion of which is shown) at sequential stages during the passage thereof through the rotors.

In FIG. 1A, the branch 75 is shown being initially attacked by the leading edge of the squared-off end of a blade 72 of the left rotor (as viewed in FIG. A). This engagement initiates downward rapid movement of the branch, a function which is accelerated when the following blade 72 of the right rotor engages the branch.

FIG. 1B illustrates what happens to the branch when it is generally half way through the rotors. As is clearly seen, a blade 72 of one rotor is virtually perpendicular to the blade 72 of the other rotor, with the branch 75 being crushed therebetween. In other words, the flat surface of the distal end of one of the left rotor blades is momentarily essentially parallel to the spaced side 74 of a blade 72 of the right rotor and defines a crushing nip therewith. This ensures not only that significant crushing of the branch occurs but also that the crushing takes place over a significant length of the branch.

Continued rotation of the rotors discharges the crushed sections of the branch or other material in a manner shown in FIG. 1C.

It has been found that with the present arrangement the rotational speed of the rotors may be considerably less, e.g. in the order of 320 rpm or so, than that of the device disclosed in U.S. Pat. No. 3,735,933. The ends of the blades are preferably adjusted to approach within 0.01 inches from the sides of the blades of the opposing rotor. A branch or other plant material is quickly crushed by the blades to a thickness equal to the clearance.

Device 10 incorporates yet another feature which contributes to its operating efficiency. Referring now to FIG. 1, it will be seen that each rotor has operatively associated therewith a deflector plate 88. Each deflector plate 88 has a terminal portion 90 in close proximity with the distal ends of blades 72 on its associated rotor. The deflector plate terminal portion 90 is adapted to be engaged by material adhering to the blade distal ends upon rotation of the associated rotor and to remove such material from the rotor. The terminal portion includes a terminal edge 92 and a deflector surface 94 leading from the edge and adapted to direct material removed from the blade distal ends away from the rotor. Placement of each deflector plate 88 is important in that the terminal edge thereof must be maintained in substantial registry and alignment with the rotational axis of the rotor with which it is associated.

Figure 3:
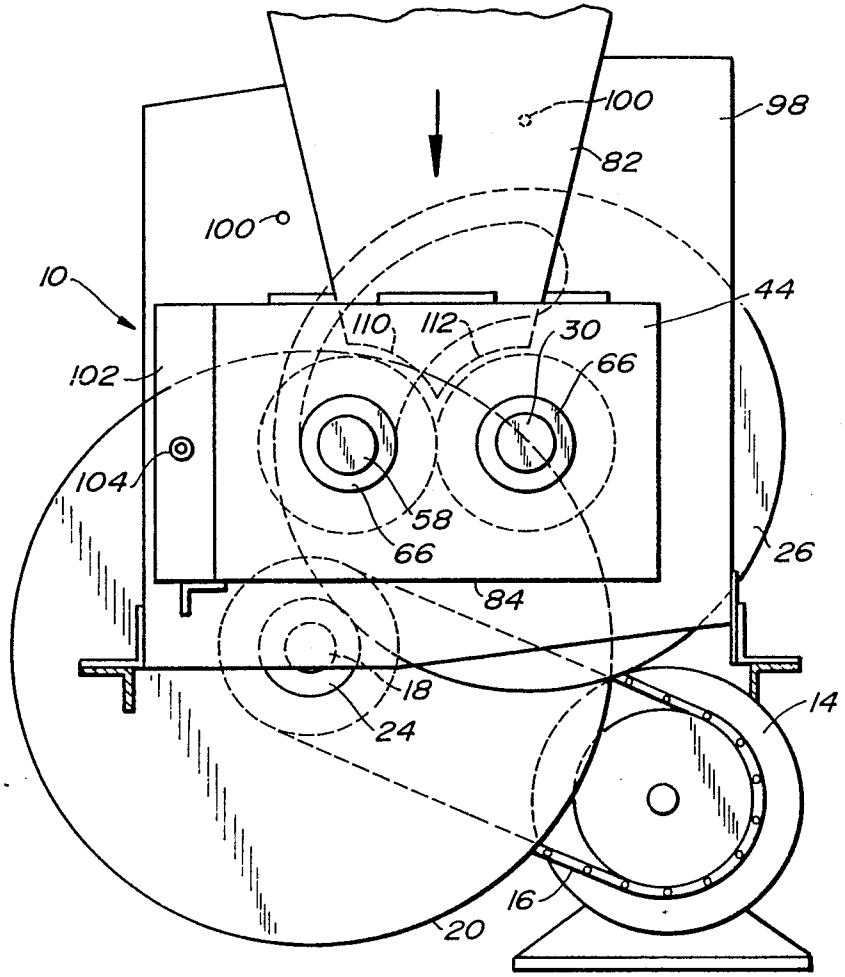
FIG. 3 is a slightly enlarged side view taken along the line 3—3 in FIG. 2 of the device illustrating the housing thereof in one position.
Figure 4:
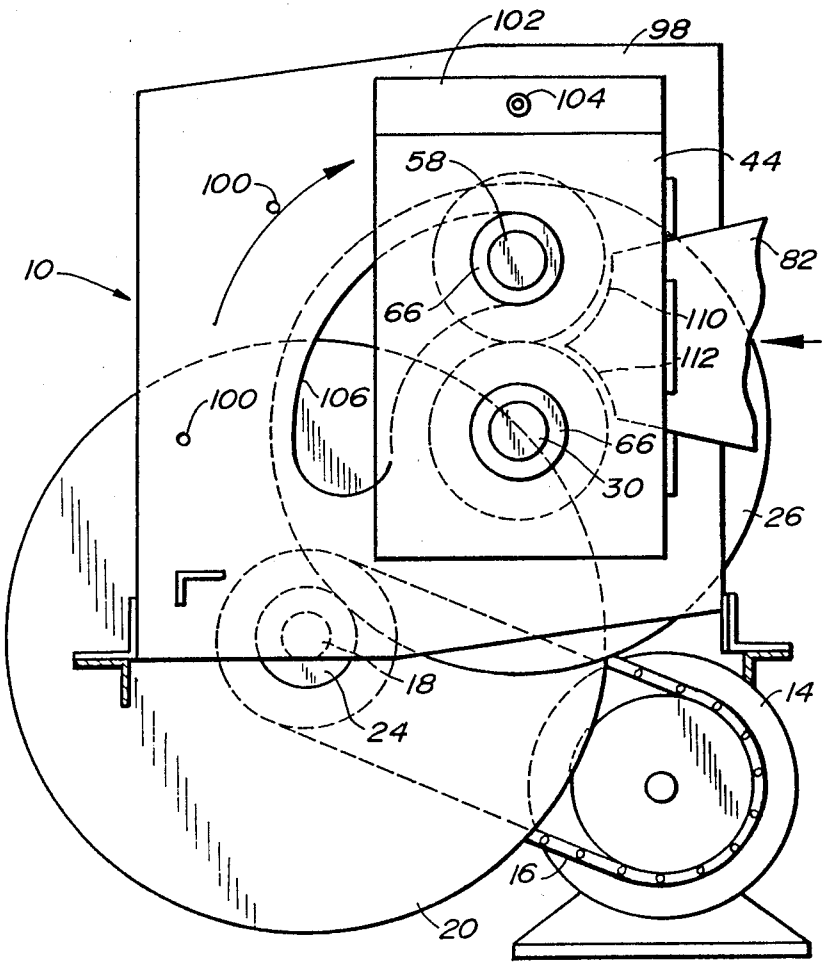
FIG. 4 is a view similar to that of FIG. 3 but illustrating the housing in an alternate position.

Disposed next to housing 44 is an upstanding support plate 98 comprising one side of an enclosure for the previously described power train components of the device. Support plate 98 has a plurality of apertures 100 therein. The support plate cooperates with the housing and provides a means whereby the housing may be adjusted between a position (FIG. 3) where the inlet 82 is horizontal to a position (FIG. 4) where the inlet is vertically disposed.

An extension 102 is formed on side wall 40, the extension being parallel to the support plate 98. A pin 104 extending through an aperture (not shown) in the extension and a selected one of apertures 100 enables the housing to be adjustably positioned since the housing is freely rotatably mounted on shaft 30. An arcuate opening 106 in support plate 98 accommodates movement of rotor shaft 58.

It will be appreciated that all of the aforesaid components are mounted on a suitable framework (not shown) which may, for example, be similar in construction to that disclosed in U.S. Pat. No. 3,735,933.

Preferably the inlet of housing 44 is defined by a downwardly converging hopper 82 through which branches and other material are directed to the rotors. The hopper should be relatively long and the bottom thereof relatively restricted (for example, 3 inches by 3 inches) in order to make it difficult, if not impossible, for the operator to stick a hand between the rotors. Preferably two opposed side walls or plates of the hopper extend into the housing 44 and into close proximity to the rotors. The lower edges of these side walls or plates are curved as at 110, 112 so as to generally conform to the outer dimensions of the rotors and are adapted to resist the migration of material being fed to the machine to the ends of the rotors.

I claim:

1. A device for crushing plant material, said device comprising, in combination:

a housing defining an interior and an inlet and an outlet communicating with said interior;

a pair of contra rotating rotors rotatably mounted within said interior and defining a passageway therebetween between said inlet and said outlet, each said rotor including a cylindrically-shaped core member and a plurality of generally uniformly spaced blades projecting outwardly from said core member into the space between blades on the other of said core members, each said blade having a positive rake angle, spaced flat sides, and a distal end, said distal end having a flat surface disposed at substantially 90 degree angles to said sides and interconnected to said sides along sharp edges, each blade positioned to project into the space between blades on the other said rotor sufficiently for the distal end of each blade to be in crushing proximity to a flat spaced side of another blade.

2. The device according to claim 1 wherein said rake angle is generally in the order of about 33 degrees.

3. The device according to claim 2 wherein six blades project outwardly from said core member.

4. The device according to claim 1 wherein each said core member comprises a shaft and at least one tubular spacer secured to said shaft and said blades, each said tubular spacer being shorter than the shaft to which the tubular spacer is secured whereby the ends of said tubular spacers are adapted to define thrust-bearing surfaces.

5. The device according to claim 4 wherein said housing is selectively rotatable about the shaft of one of said rotors.

6. The device according to claim 1 additionally comprising a deflector plate in operative association with at least one of said rotors, said deflector plate having a terminal portion thereof in close proximity with the distal ends of blades on said associated rotor whereby said deflector plate terminal portion is adapted to be engaged by material adhering to said blade distal ends upon rotation of said associated rotor and remove such material from said associated rotor.

7. The device according to claim 6 wherein said deflector plate terminal portion includes a terminal edge and a deflector surface leading from said edge and adapted to direct material removed from said blade distal ends away from said associated rotor.

8. The device according to claim 7 wherein said deflector plate terminal edge is in substantial registry and alignment with the rotational axis of said associated rotor.

9. The device according to claim 6 wherein deflector plates are operatively associated with both of said rotors.

10. The device according to claim 1 wherein said blades are tangentially disposed on said core members.

11. The device according to claim 10 wherein said blades are welded to said core members.

12. The device according to claim 1 wherein the flat distal end surfaces of the blades of each of said rotors are adapted for placement in close proximity with the flat sides of the blades of the other of said rotors during rotation thereof and substantially parallel thereto to define crushing nips for crushing said plant material at spaced locations thereon.

* * * * *